United States Patent [19]

Duis

[11] 4,000,847

[45] Jan. 4, 1977

[54] MAIL INDICATOR USED IN CONJUNCTION WITH A MAILBOX

[76] Inventor: Jack L. Duis, 2784 Copp Road, Niles, Mich. 49120

[22] Filed: Jan. 16, 1976

[21] Appl. No.: 649,661

Related U.S. Application Data

[63] Continuation-in-part of Ser. No. 599,830, July 28, 1975, abandoned.

[52] U.S. Cl. ..... 232/35

[51] Int. Cl.[2] ..... G08C 5/00

[58] Field of Search ..... 232/34, 35; 248/102, 248/104, 105, 318

[56] References Cited

UNITED STATES PATENTS

| | | | |
|---|---|---|---|
| 2,428,423 | 10/1947 | Hurban | 232/35 |
| 2,433,940 | 1/1948 | Weaver | 232/35 |
| 3,482,543 | 12/1969 | Guidos | 232/35 |
| 3,596,631 | 8/1971 | Sutton | 232/35 |
| 3,866,823 | 2/1975 | Grayson | 232/35 |

*Primary Examiner*—Roy D. Frazier
*Assistant Examiner*—Peter A. Aschenbrenner
*Attorney, Agent, or Firm*—Oltsch & Knoblock

[57] ABSTRACT

An elongated shape retaining flexible member having its lower end secured to the door latch of a mailbox. The opposite end of the flexible member is designed to be compressed between the mailbox door and mailbox housing when the door is closed so as to retain the elongated flexible member in a downbent position. When the mailbox door is opened the upper end of the flexible member is released so that it springs or flexes into an upright position indicating the receipt of mail.

7 Claims, 6 Drawing Figures

MAIL INDICATOR USED IN CONJUNCTION WITH A MAILBOX

CROSS REFERENCE TO A RELATED APPLICATION

This application is a continuation-in-part of application Ser. No. 599,830, filed July 28, 1975, now abandoned.

SUMMARY OF THE INVENTION

This invention relates to an indicator which is used in conjunction with a mailbox and which indicates the opening of the mailbox door when mail is deposited within the box.

In this invention an elongated flexible member, which may be of a helical spring construction, is provided. The lower end portion of the elongated flexible member is wrapped around and interlocked to the latch which is connected to the mailbox housing and which serves to secure the door of the mailbox in its closed position. The upper or opposite end portion of the elongated flexible member is bent downwardly and secured between the mailbox door and mailbox housing when the door is in its closed position. When the door is opened the upper end portion of the elongated flexible member is released and allowed to flex into its upright signal indicating position.

Accordingly, it is an object of this invention to provide an indicator which is attachable to a mailbox and which serves to indicate when the door of the mailbox has been opened such as to allow the deposit of mail within the box.

Another object of this invention is to provide a mail indicator which is used in conjunction with a mailbox and which is of economical construction.

Still another object of this invention is to provide a mail indicator which is used in conjunction with a mailbox and which may be connected to the mailbox without the need of hand tools.

Other objects of this invention will become apparent upon a reading of the invention's description.

DESCRIPTION OF THE PREFERRED EMBODIMENTS

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

Figure 1:
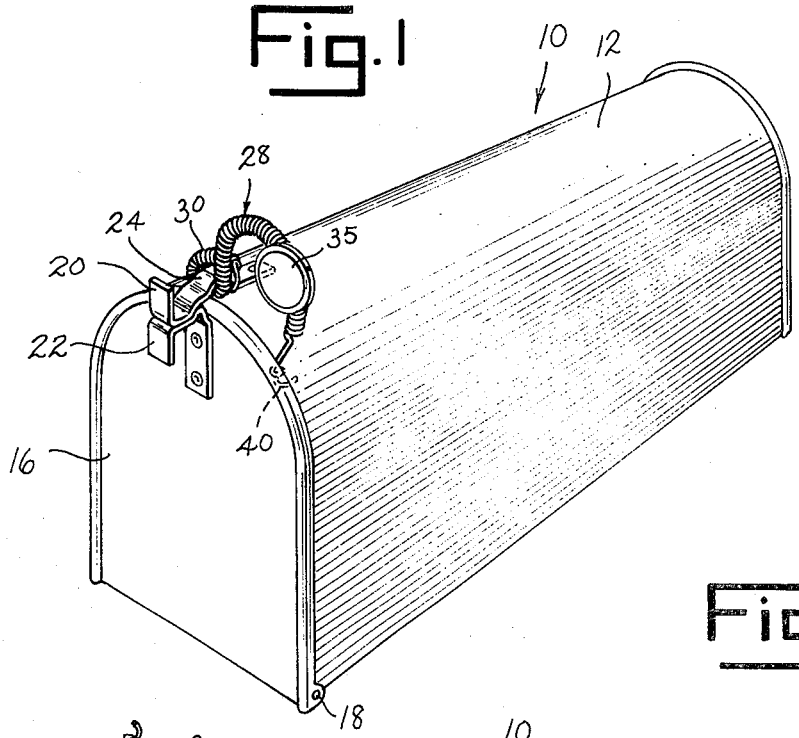
FIG. 1 is a perspective view of a mailbox with its door closed and having the mail indicator of this invention secured thereto.
Figure 3:
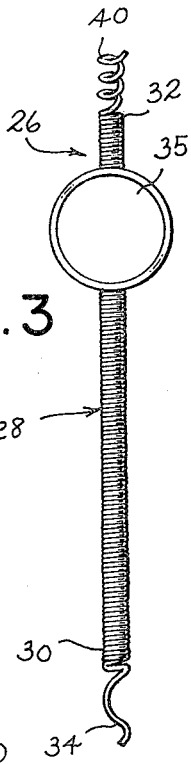
FIG. 3 is a front view of the mail indicator shown detached from the mailbox.

The mailbox 10 shown in FIG. 1 includes a housing 12 having an open front end 14. A door 16 is pivotally connected at its lower edge by rivets 18 (one only shown) to housing 10 so as to be pivotal between the closed position shown in FIG. 1 and an open position exposing the interior of housing 12. A latch 20 is riveted, welded or otherwise bonded to the top of mailbox housing 12 and projects forwardly of open end 14 of the mailbox. A gripping tab 22 is secured by rivets, welding or other bonding means to mailbox door 16 adjacent its upper edge. Tab 22 is cammed under and interlocks with latch 20 when door 16 is closed so as to secure the door in its closed position. Intermediate portion 24 of latch 20 is upwardly offset and spaced from the top of mailbox housing 12. Mailbox 10 as described is of a standard, commercially available construction. Box 10 is also mounted in a suitable way adjacent the roadway so as to permit the mailman to have ready access to the box during his mail pickup and delivery run.

Mail indicator 26 which is connected to mailbox 10 includes an elongated flexible shape-retaining helical spring member 28 having a lower end portion 30 and an upper end portion 32. Lower end portion 30 of spring member 28 terminates in a hook 34. A visual device 35 is connected to spring member 28 at its upper end portion 32. To facilitate viewing of mail indicator 26, visual device 35 and, if desired, spring member 28 may be coated, painted or otherwise provided with a luminescent or similar light reflecting material.

Figure 2:
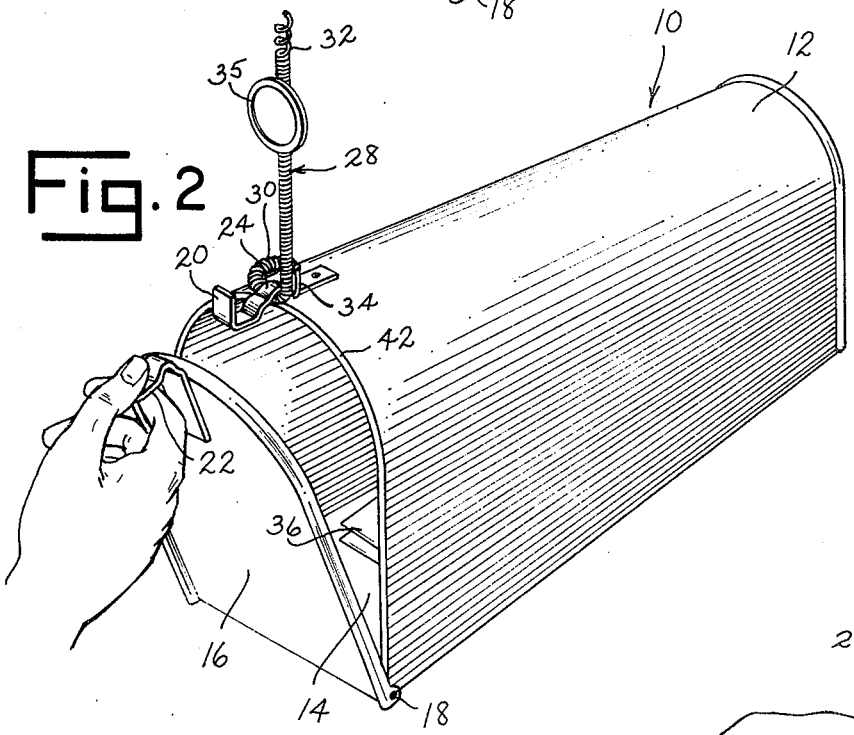
FIG. 2 is a perspective view of the mailbox shown with its door being closed and with the mail indicator of this invention extending into its upright signal indicating position.
Figure 4:
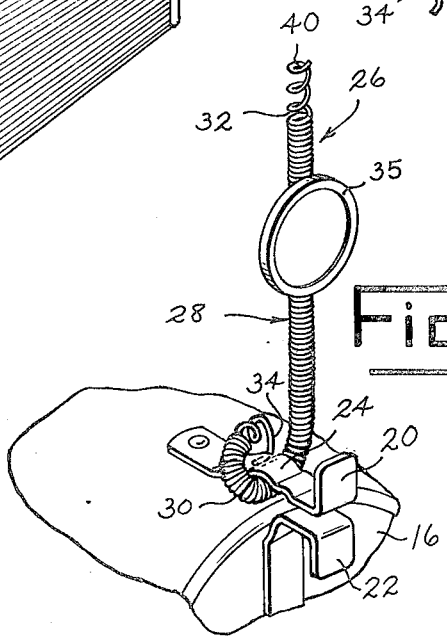
FIG. 4 is a detailed perspective view of the mail indicator shown attached to the mailbox.

Mail indicator 26 is secured to mailbox 10 in FIGS. 1, 2 and 4 by having lower end portion 30 of spring member 28 inserted under intermediate portion 24 of latch 20 between the latch and the top of housing 12. End portion 30 is then reverse bent over latch 20 with its hook 34 being inserted and interlocked under the latch adjacent the place where the latch is connected to housing 12. Spring member 28 is then upwardly sprung where it projects from under latch portion 20 to cause its upper end portion 32 to project upwardly in a free standing or free state mail-indicating position as illustrated in FIGS. 2 and 4. The relative stiffness of the spring member 28 prevents upper end portion 32 from assuming a free standing drooping or flexed downward position.

When the mailbox user wishes to utilize mail indicator 26 to indicate that the mailbox door has been opened, presumably by the mailman for the purpose of inserting mail 36 into the mailbox housing 12, the upper end portion 32 of spring member 28 is bent downwardly and its extended end 40 placed adjacent edge 42 of the open front end 14 of mailbox housing 12. Door 16 of the mailbox is then closed so as to overlap end 40 of the spring member and to cause the end to be compressed between the door and mailbox housing. This releasably secures upper end portion 32 of spring member 28 in a downbent position, as shown in FIG. 1, with the tab 22 of door 16 of the mailbox being interlocked with latch 20 of mailbox housing 12. When door 16 of the mailbox is opened by the mailman for the purpose of depositing mail within the door, end 40 of spring member 28 will be freed to allow its upper end portion 32 to flex into its upright signal indicating position.

Figure 5:
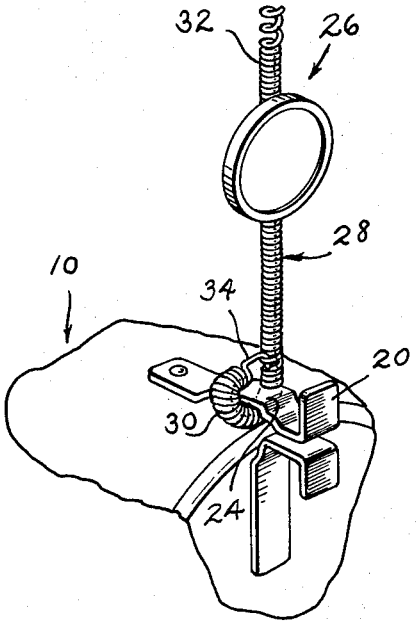
FIG. 5 is a perspective view of the mail indicator shown applied to the mailbox in a modified manner.
Figure 6:
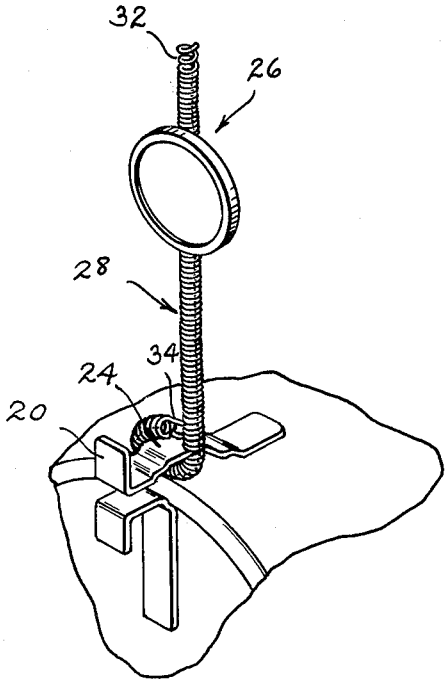
FIG. 6 is another perspective view of the mail indicator shown in FIG. 5.

In FIGS. 5 and 6 another way of attaching mail indicator 26 to mailbox 10 is shown. Lower end portion 30 of spring member 28 is inserted under intermediate portion 24 of mailbox latch 20 with adjacent turns of spring member 28 being fitted over and under the latch to cause upper end portion 32 of the spring member to project upwardly in a free standing mail-indicating position. End portion 30 is then reverse bent over latch 20 with its hook 34 being either inserted and interlocked under the latch as shown in FIGS. 2 and 4 or interlocked into spring member 28 adjacently above (see FIG. 5) or below latch portion 24. The mail indicator 26 shown in FIGS. 5 and 6 works in the same manner to indicate the receipt of mail as the indicator shown in FIGS. 1–4.

It is to be understood that the invention is not to be limited to the details above given but may be modified within the scope of the appended claims.

What I claim is:

1. In combination a mail indicator and a mailbox comprising an elongated shape-retaining flexible member having upper and lower end portions and defining said mail indicator, said member lower end portion terminating in a hook part, said mailbox including a housing means for receiving mail, said housing means including an open front end, a door, means pivotally connecting said door to said housing means for movement between a closed position spanning said housing means open end and an open position exposing said housing means open end, a latch part mounted to said housing means adjacent its said open end, said door including a tab part, said latch part having one end secured to said housing means and another end releasably engaged with said door when the door is located in its closed position, said latch part including an intermediate portion between its said ends offset from said housing means, the lower end portion of said member extending under said latch part intermediate portion between said intermediate portion and housing means and being return bent over said intermediate portion with said hook part interlocking under said intermediate portion, the upper end portion of said member having an upwardly extending signal indicating position, said upper end portion being flexibly downbent and secured between said door and housing means with said door in its closed position, said upper end portion shifting into its upwardly extending signal indicating position when said door is opened.

2. The mail indicator and box of claim 1 and a visual indicator means carried by said upper end portion.

3. The mail indicator and box of claim 2 wherein said member is a helical spring.

4. In combination a mail indicator and a mailbox comprising an elongated shape-retaining flexible helical spring member having upper and lower end portions and including multiple overlapping turns, said member lower end portion terminating in a hook part, said mailbox including a housing means for receiving mail, said housing means including an open front end, a door, means pivotally connecting said door to said housing means for movement between a closed position spanning said housing means open end and an open position exposing said housing means open end, a latch part mounted to said housing means adjacent its said open end, said door including a tab part, said latch part having one end secured to said housing means and another end releasably engaged with said door when the door is located in its closed position, said latch part including an intermediate portion between its said ends offset from said housing means, the lower end portion of said member extending under said latch part intermediate portion between said intermediate portion and housing means with adjacent turns of the member fitting above and below said latch part intermediate portion and clamping the intermediate portion therebetween, said member being return bent over said intermediate portion with said hook part interlocking with either said intermediate portion or said member, the upper end portion of said member having an upwardly extending signal indicating position, said upper end portion being flexibly downbent and secured between said door and housing means with said door in its closed position, said upper end portion shifting into its upwardly extending signal indicating position when said door is opened.

5. The mail indicator of claim 4 wherein the hook part of said member interlocks with said member where the member projects from under said latch part intermediate portion.

6. The mail indicator of claim 4 wherein the hook part of said member interlocks under said latch part intermediate portion.

7. The mail indicator of claim 4 and a visual indicator means carried by said upper end portion.

* * * * *